US007281396B2

(12) United States Patent
Lonati et al.

(10) Patent No.: US 7,281,396 B2
(45) Date of Patent: Oct. 16, 2007

(54) MEDIUM- OR LARGE-DIAMETER SINGLE-CYLINDER CIRCULAR KNITTING MACHINE WITH RADIALLY COMPACT SINKER RING

(75) Inventors: Ettore Lonati, Brescia (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 10/578,519

(22) PCT Filed: Sep. 28, 2004

(86) PCT No.: PCT/EP2004/010851

§ 371 (c)(1),
(2), (4) Date: May 8, 2006

(87) PCT Pub. No.: WO2005/054556

PCT Pub. Date: Jun. 16, 2005

(65) Prior Publication Data

US 2007/0084249 A1 Apr. 19, 2007

(30) Foreign Application Priority Data

Nov. 25, 2003 (IT) ..... MI2003A2300

(51) Int. Cl.
*D04B 15/06* (2006.01)

(52) U.S. Cl. ..... 66/108; 66/107
(58) Field of Classification Search ..... 66/8, 66/13, 17, 19, 104, 107–108 A
See application file for complete search history.

(56) References Cited

U.S. PATENT DOCUMENTS

| | | | | | |
|---|---|---|---|---|---|
| 4,608,839 | A | * | 9/1986 | Tibbals, Jr. | 66/13 |
| 4,696,170 | A | * | 9/1987 | Tibbals, Jr. | 66/120 |
| 4,711,100 | A | * | 12/1987 | Tibbals, Jr. | 66/55 |
| 4,738,123 | A | * | 4/1988 | Tibbals, Jr. | 66/13 |
| 4,763,492 | A | * | 8/1988 | Tibbals, Jr. | 66/232 |
| 4,796,444 | A | * | 1/1989 | Tibbals, Jr. | 66/13 |
| 4,811,572 | A | * | 3/1989 | Tibbals, Jr. | 66/13 |
| 4,941,332 | A | * | 7/1990 | Tibbals, Jr. | 66/104 |
| 5,001,909 | A | * | 3/1991 | Tibbals, Jr. | 66/9 R |
| 5,035,124 | A | * | 7/1991 | Tibbals, Jr. | 66/120 |
| 5,095,720 | A | * | 3/1992 | Tibbals, Jr. | 66/55 |
| 5,133,196 | A | * | 7/1992 | Tibbals, Jr. | 66/35 |
| 5,144,817 | A | * | 9/1992 | Tibbals, Jr. | 66/140 R |

FOREIGN PATENT DOCUMENTS

| | | |
|---|---|---|
| EP | 0 396 207 A | 11/1990 |
| GB | 245 928 A | 1/1926 |
| GB | 759 137 A | 10/1956 |

* cited by examiner

*Primary Examiner*—Danny Worrell
(74) *Attorney, Agent, or Firm*—Modiano & Associati; Albert Josif; Daniel J. O'Byrne

(57) ABSTRACT

A medium- or large-diameter single-cylinder circular knitting machine with a radially compact sinker ring, comprising a needle cylinder that has a vertical axis and a sinker ring that is connected coaxially to the needle cylinder proximate to the upper end of the needle cylinder. The sinker ring has a plurality of radial slots, each of which accommodates at least one sinker, the sinker ring being arranged inside the radial dimensions of the needle cylinder and the sinkers being shaped so that their beak is directed toward the axis of the needle cylinder.

12 Claims, 3 Drawing Sheets

MEDIUM- OR LARGE-DIAMETER SINGLE-CYLINDER CIRCULAR KNITTING MACHINE WITH RADIALLY COMPACT SINKER RING

TECHNICAL FIELD

The present invention relates to a medium- or large-diameter single-cylinder circular knitting machine with radially compact sinker ring.

The expression "medium- or large-diameter single-cylinder circular machine" is used to designate a machine in which the needle cylinder diameter exceeds 4.5 inches (11,43 cm).

BACKGROUND ART

As is known, in single-cylinder circular knitting machines the sinker ring, hereinafter called "sinkers", is generally fixed coaxially at the upper end of the needle cylinder and extends outside the dimensions of the needle cylinder.

This arrangement of the sinker ring makes it difficult to use special needles, for example of the type disclosed in WO-02/070799, which allow to provide open-knit fabrics and knitting with ladderproof weave. Moreover, the presence of the sinker ring outside the needle cylinder, in known types of machine, is in any case a bulk that makes it more difficult to arrange devices that must face the needle cylinder laterally, such as for example needle control and actuation devices.

DISCLOSURE OF THE INVENTION

The aim of the present invention is to solve the problems noted above by providing a medium- or large-diameter single-cylinder circular knitting machine for hosiery or the like, in which the sinker ring has an extremely compact space occupation, or none at all, around the needle cylinder.

Within this aim, an object of the invention is to provide a machine that allows to reduce the problems linked to the adoption of special needles provided with protruding parts around the needle cylinder and/or of devices to be arranged so as to face laterally the needle cylinder proximate to the upper end of said needle cylinder.

Another object of the invention is to provide a machine that is highly reliable in operation and has excellent control over the movement of the sinkers even at high rotation rates of the needle cylinder.

This aim and these and other objects that will become better apparent hereinafter are achieved by a medium- or large-diameter single-cylinder circular knitting machine, comprising a needle cylinder that has a vertical axis and a sinker ring that is connected coaxially to said needle cylinder proximate to the upper end of the needle cylinder, said sinker ring having a plurality of radial slots, each of which accommodates at least one sinker, characterized in that said sinker ring is arranged inside the radial dimensions of said needle cylinder, said sinkers having a beak that is directed toward the axis of the needle cylinder.

BRIEF DESCRIPTION OF THE DRAWINGS

Further characteristics and advantages of the invention will become better apparent from the detailed description of a preferred but not exclusive embodiment of the machine according to the invention, illustrated by way of non-limiting example in the accompanying drawings, wherein.

WAYS TO CARRYING OUT THE INVENTION

Figure 1:
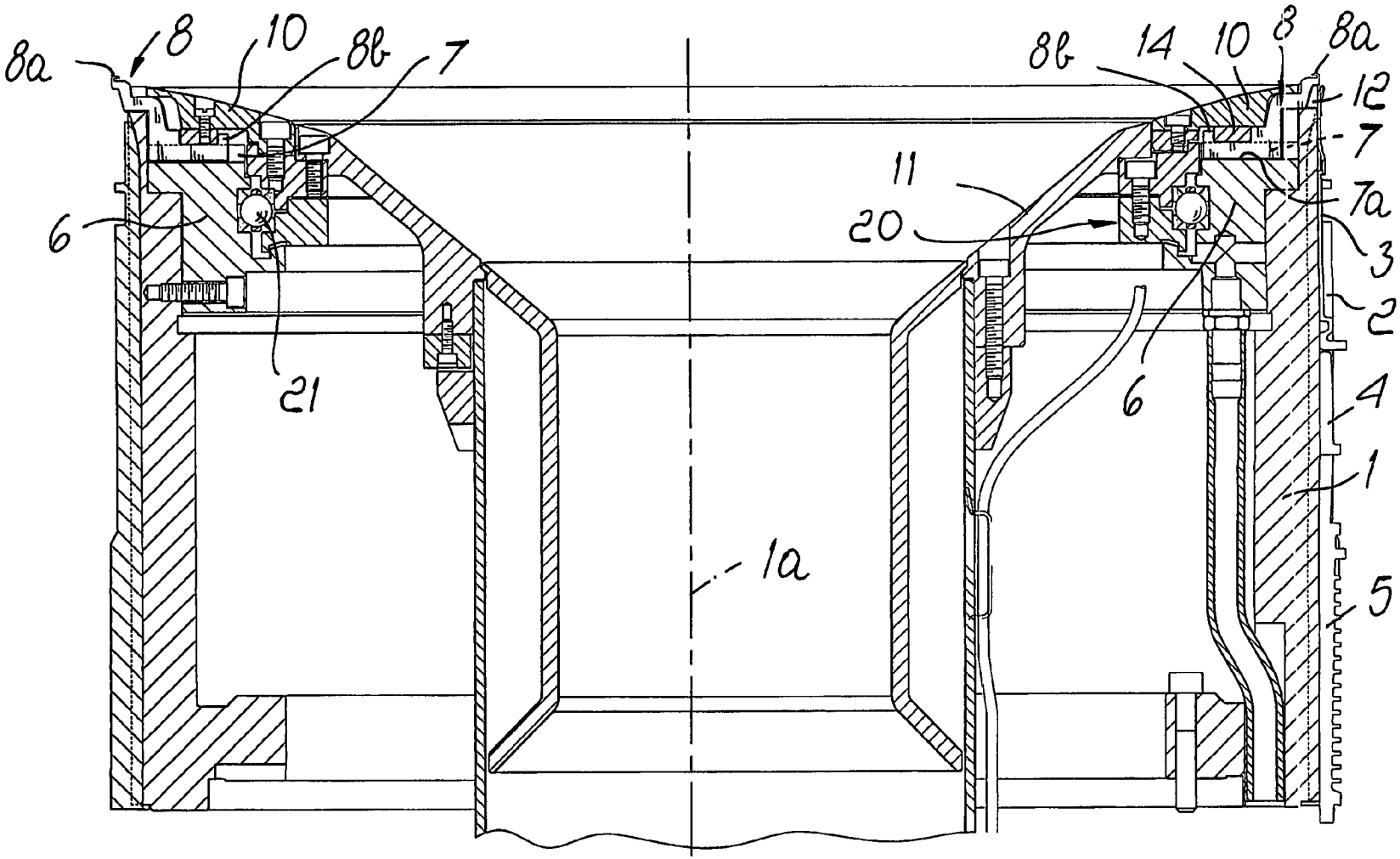
FIG. 1 is a schematic axial sectional view of the needle cylinder of the machine according to the invention.
Figure 2:
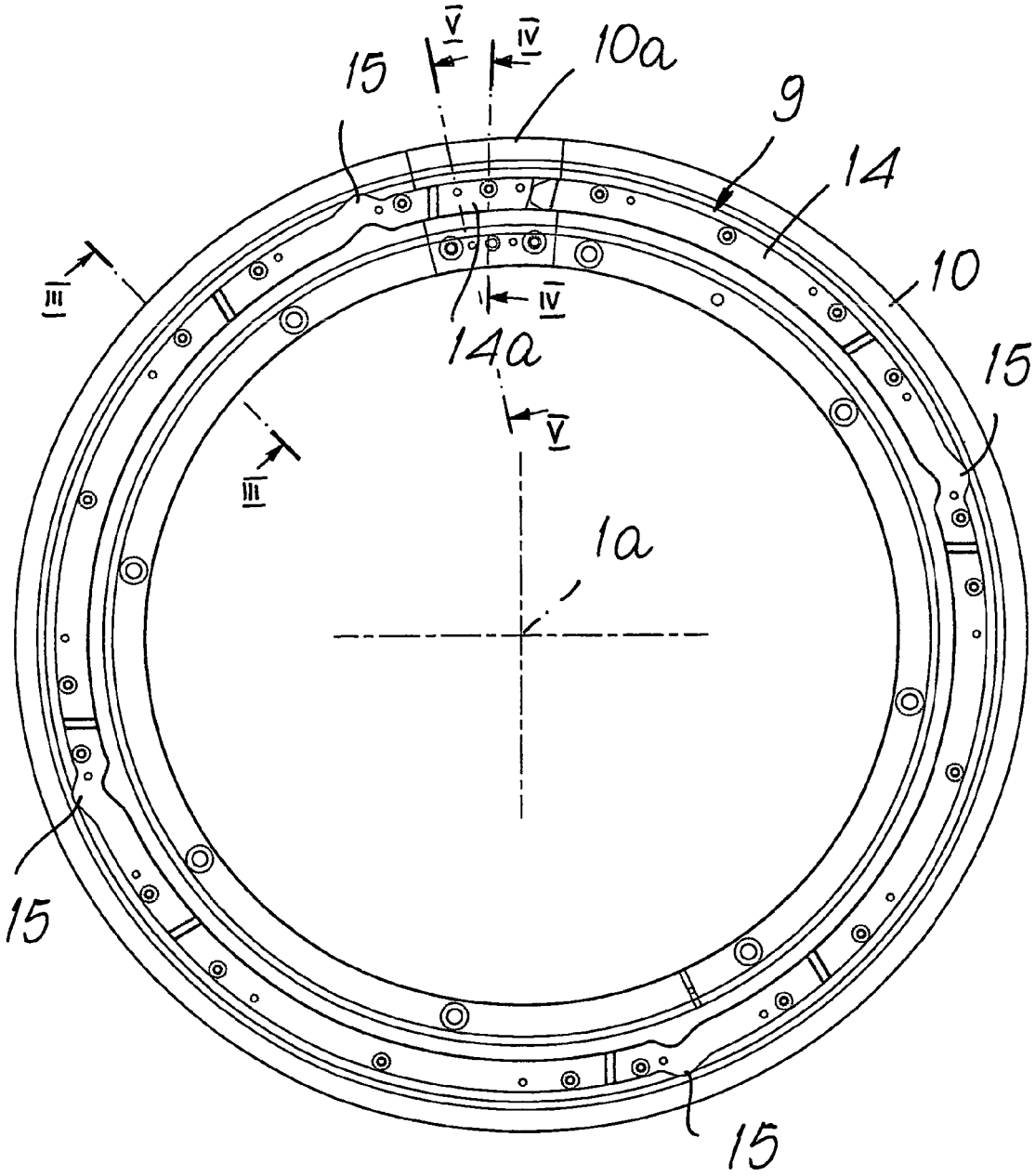
FIG. 2 is a schematic bottom plan view of the sinker cap of the machine according to the invention.
Figure 4:
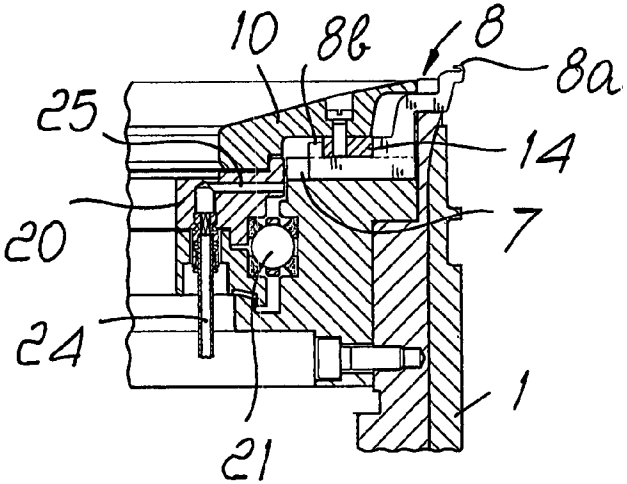
FIG. 4 is a sectional view of a portion of the needle cylinder of the machine according to the invention, taken along the line IV-IV, shown in FIG. 2.

With reference to the figures, the machine according to the invention, shown only partially for the sake of simplicity, comprises a needle cylinder 1, with a vertical axis 1*a*, on the outer lateral surface of which a plurality of axial slots 2 is provided, each of which accommodates at least one needle 3 that can slide in a per se known manner along the corresponding axial slot 2 in order to form knitting. Other elements for actuating the needles 3, such as for example sub-needles 4 and selectors 5, of a known type and not described further for the sake of simplicity, can be arranged in the axial slots 2.

The machine according to the invention also comprises a sinker ring 6, which is fixed coaxially to the needle cylinder 1 proximate to its upper end. The sinker ring 6 has a plurality of radial slots 7, each of which internally slidingly accommodates at least one sinker 8.

According to the invention, the sinker ring 6 is arranged inside the radial dimensions of the needle cylinder 1, in other words it has a radial extension such that it lays in, and is comprised within, the overall radial dimensions of the needle cylinder. The sinkers 8 have a beak 8*a* that is directed toward the axis 1*a* of the needle cylinder 1 and is designed to engage the thread knitted by the needles 3.

The sinkers 8 have a laminar body that is provided, along its upper side, with an actuation heel 8*b*, which protrudes upwardly from the corresponding radial slot 7 and can engage actuation cams 9, which are connected to a sinker cap 10 that faces the sinker ring 6 in an upward region. The sinker cap 10 is disengaged from the rotation of the needle cylinder 1 and of the sinker ring 6, which can be rotationally actuated about the axis 1*a* with respect to the sinker cap 10.

More particularly, the sinker cap 10 is fixed to a goblet-like element 11, which as in known types of single-cylinder machine is arranged internally and coaxially to the needle cylinder 1.

Preferably, the sinker cap 10 is provided as a peripheral rim of the goblet-like element 11, and its upper face defines a conical surface that widens upwardly, as an extension of the upper face of the goblet-like element 11.

The radial slots 7 of the sinker ring 6 have a bottom 7*a*, on which the corresponding sinker 8 rests, which is preferably arranged on a plane that is substantially perpendicular to the axis 1*a* and is recessed with respect to the upper end of the needle cylinder 1.

Conveniently, a radial slot 12 is provided in the upper end of the needle cylinder 1 between two contiguous axial slots 2 that accommodate respective needles 3, is aligned with a corresponding radial slot 7 of the sinker ring 6, and slidingly accommodates a portion of the corresponding sinker 8, forming another resting surface in addition to the surface of the bottom 7*a* on which another portion of the sinker 8 rests. Said other resting surface is at a higher level than the bottom 7*a*.

More particularly, the lower side of the sinker 8 is step-shaped, with two resting surfaces for the sinker 8, respectively a lower resting surface 8*c*, which engages the bottom 7*a* of the radial slot 7 formed in the sinker ring 6, and an upper resting surface 8*d*, which engages the bottom of the radial slot 12 formed in the upper end of the needle cylinder 1.

Figure 6:
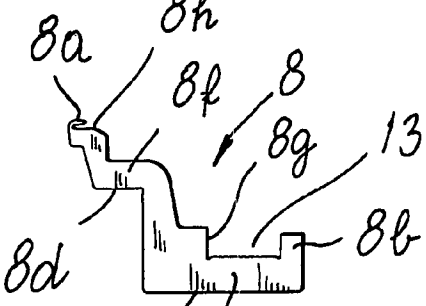
FIG. 6 is a side elevation view of a sinker of the machine according to the invention.

Each sinker 8 preferably has a first portion 8*e*, which is delimited in a downward region by the lower resting surface 8*c* and is provided in an upward region with the heel 8*b*, upward and downward refer to a possible position of the sinker as shown in FIG. 6, and may be arranged in a working configuration, and a second portion 8*f*, which is delimited in a downward region by the upper resting surface 8*d* and is provided with the beak 8*a*. On the first portion 8*e* there is a shoulder 8*g*, which is arranged opposite the heel 8*b*. In this manner, a seat 13 designed to be engaged by the cams 9 is formed between the heel 8*b* and the shoulder 8*g*.

The cams 9 are preferably constituted by an annular cam 14, which is fixed below the sinker cap 10 and lies coaxially to the sinker ring 6. The annular cam 14 has contoured portions 15, so as to have parts that approach the axis 1*a* and parts that move away from it, in order to impart to the sinkers 8, as a consequence of the rotation of the needle cylinder 1 and of the sinker ring 6 about the axis 1*a* with respect to the annular cam 14, a reciprocating movement toward and away from the axis 1*a*, so that the sinkers 8 can cooperate, in a per se known manner, with the needles 3 in the formation of stitches.

The embodiment shown relates to a circular machine with four feeds or drops, and therefore the annular cam 14 has four contoured portions 15, one for each one of the feeds or drops of the machine.

Conveniently, along the extension of the sinker cap 10 and along the extension of the annular cam 14 it is possible to provide a removable portion, designated by the reference numerals 10*a* and 14*a* respectively, to allow easy extraction of damaged or worn sinkers 8 and their replacement with new sinkers 8.

In practice, with respect to the sinkers with which known types of single-cylinder machine are equipped, the sinkers 8 in the machine according to the invention have a beak 8*a*, which is hook-shaped and directed toward the heel 8*b*.

In the machine according to the invention, the sinker cap 10 and the upper end of the goblet-like element 11 are fixed to a supporting ring 20, which is arranged inside the sinker ring 6 and is connected thereto by means of a bearing 21, which is coaxial to the sinker ring 6, so that the sinker ring 6 can rotate about the axis 1*a*, together with the needle cylinder 1, while the goblet-like element 11 and the sinker cap 10 remain stationary.

Figure 3:
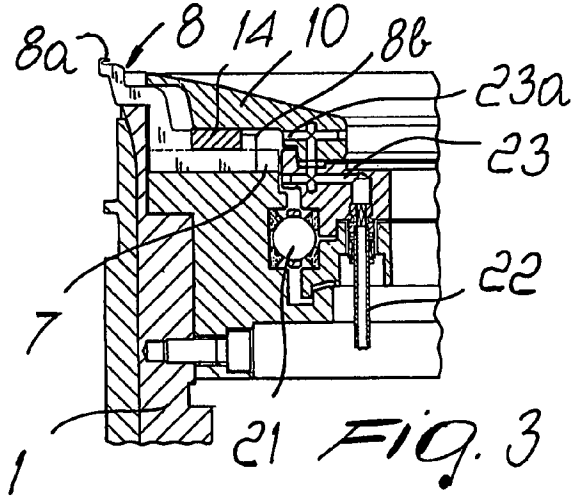
FIG. 3 is a sectional view of a portion of the needle cylinder of the machine according to the invention, taken along the line III-III, shown in FIG. 2.
Figure 5:
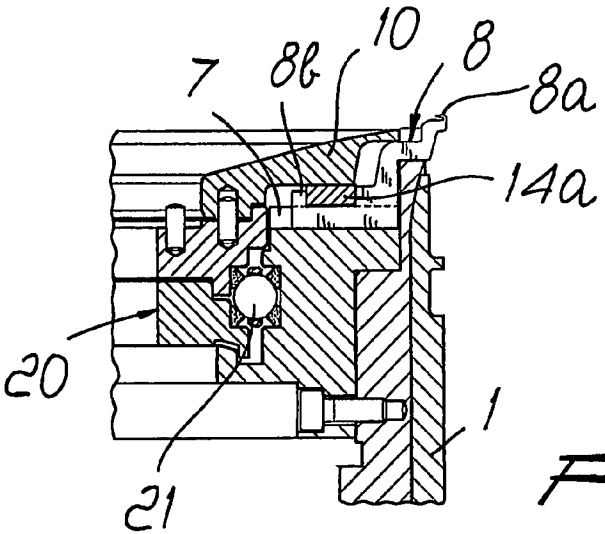
FIG. 5 is a sectional view of a portion of the needle cylinder of the machine according to the invention, taken along the line V-V, shown in FIG. 2.

For the sake of completeness in description, it should be noted that the machine according to the invention is provided with a circuit for lubricating the radial slots 7 and the bearing 21. As shown in FIG. 3, a first lubrication duct 22 is connected to the supporting ring 20 and feeds a distribution duct 23 formed in the supporting ring 20 and provided with outlets 23*a* at the radial slots 7. The lubrication circuit comprises a second lubrication duct 24, which is connected to the supporting ring 20 and feeds a duct 25 that leads into the interspace that accommodates the bearing 21.

Operation of the machine according to the invention is as follows.

When the needle cylinder 1 and the sinker ring 6 are rotationally actuated about the axis 1*a*, the sinkers 8 move along the profile of the annular cam 14, which at the contoured portions 15 moves the sinkers 8 away from the axis 1*a*, while the needles 3, after engaging the thread at a feed or drop of the machine, move downwardly to form new loops of knitting so that the thread rests on the knitting forming surface 8*h* arranged proximate to the beak 8*a*. During the upward motion of the needles 3 to engage a new thread, the sinkers 8, as a consequence of the shape of the annular cam 14, are again moved toward the axis 1*a*, so as to tension, on the stem of the corresponding needles 3, the loops of knitting formed previously by said needles, as in known types of circular machine.

It should be noted that the resting of the sinkers 8 also on the bottom of the slots 12, since said resting is located in the direct vicinity of the beak 8*a* and of the knitting forming surface 8*h*, i.e., the regions of the sinkers on which the forces exchanged between the thread and the sinkers are discharged, achieves high stability of the sinkers 8 even with high actuation speeds of the needle cylinder 1 and in the presence of high tensions applied to the threads knitted by the needles 3.

Moreover, because the sinkers 8 move on a plane that is perpendicular to the axis 1*a* of the needle cylinder 1, high precision in the movement of the sinkers 8 is achieved.

In practice it has been found that the machine according to the invention fully achieves the intended aim and objects, since by arranging the sinker ring within the dimensions of the needle cylinder there are no problems in using particular needles that have protrusions on the outer side of the needle cylinder and the entire region arranged around the needle cylinder proximate to its upper end is freed.

The machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2003A002300 from which this application claims priority are incorporated herein by reference.

The invention claimed is:

1. A medium- or large-diameter single-cylinder circular knitting machine, comprising a needle cylinder that has a vertical axis and a sinker ring that is connected coaxially to said needle cylinder proximate to the upper end of the needle cylinder, said sinker ring having a plurality of radial slots, each of which accommodates at least one sinker, wherein said sinker ring is arranged inside the radial dimensions of said needle cylinder, said sinkers having a beak that is directed toward the axis of the needle cylinder and wherein said radial slots have a bottom on which the corresponding sinker rests, said bottom being arranged on a plane that is substantially perpendicular to the axis of the sinker ring.

2. The machine according to claim 1, wherein each one of said sinkers has, along its extension, at least one actuation heel that protrudes upwardly from the corresponding radial slot and is engageable with sinker actuation cams that are connected to a sinker cap facing in an upward region said sinker ring, said needle cylinder and said sinker ring being actuatable, jointly, with a rotary motion about their own axis with respect to said sinker cap.

3. The machine according to claim 2, wherein said sinker actuation cams have a shape adapted to produce a movement of the sinkers toward and away from the axis of the sinker ring as a consequence of the rotation of said sinker ring with respect to said actuation cams.

4. The machine according to claim 2, wherein said sinker cap is fixed to a goblet-like element, which is arranged internally and coaxially to said needle cylinder.

5. The machine according to claim 4, wherein said sinker cap is provided as a peripheral rim of said goblet-like element, with an upper face that is shaped like a conical surface that widens upwardly.

6. The machine according to claim 1, wherein said bottom of the radial slots of the sinker ring is recessed with respect to the upper end of the needle cylinder.

7. The machine according to claim 6, wherein a radial slot is formed in the upper end of the needle cylinder, between two contiguous axial slots that accommodate respective needles, is aligned with a corresponding radial slot of the sinker ring, and slidingly accommodates a portion of a corresponding sinker.

8. The machine according to claim 7, wherein the bottom of the radial slots formed in the needle cylinder is arranged at a higher level than the bottom of the radial slots of the sinker ring, the lower side of said sinkers being step-shaped, with two sinker resting surfaces, respectively a lower resting surface, which engages the bottom of the radial slot formed in said sinker ring, and an upper resting surface, which engages the bottom of the radial slot formed in the upper end of the needle cylinder.

9. The machine according to claim 8, wherein said sinker has a first portion that is delimited in a downward region by said lower resting surface and is provided in an upward region with said actuation heel, and a second portion that is delimited in a downward region by said upper resting surface and is provided in an upward region with said beak, a shoulder being provided on said first portion, being ranged opposite said heel, and being engageable with said sinker actuation cams.

10. The machine according to claim 9, wherein said sinker actuation cams comprise an annular cam, which is arranged coaxially to said sinker ring and has a profile with portions in which at least one part protrudes toward, and at least one part retracts from, the axis of the sinker ring, said annular cam engaging said sinkers between said sinker heel and said shoulder.

11. A sinker for a medium- or large-diameter circular knitting machine, comprising a laminar body provided with a beak proximate to a first one of its ends, wherein said beak is directed toward the second, opposite end of the laminar body, said laminar body having an upper side provided with a sinker actuation heel, said beak protruding on said upper side and being directed toward said actuation heel, wherein the lower side of said laminar body that lies opposite with respect to the upper side provided with said actuation heel has a step-like profile, with two sinker resting surfaces that are substantially flat and parallel to each other, respectively a lower resting surface and an upper resting surface that is spaced upwardly from said lower resting surface.

12. The sinker according to claim 11, wherein said laminar body has a first portion, which is delimited in a downward region by said lower resting surface and is provided in an upward region with said heel, and a second portion, which is delimited in a downward region by said upper resting surface and is provided with said beak, a shoulder being provided on said first portion and being arranged opposite said actuation heel.

* * * * *